US007252330B2

(12) United States Patent
Lincoln

(10) Patent No.: US 7,252,330 B2
(45) Date of Patent: Aug. 7, 2007

(54) CHILDREN'S CAR SEAT PILLOW

(75) Inventor: Meagan D. Lincoln, Englewood, OH (US)

(73) Assignee: Evenflo Company, Inc., Vandalia, OH (US)

( * ) Notice: Subject to any disclaimer, the term of this patent is extended or adjusted under 35 U.S.C. 154(b) by 531 days.

(21) Appl. No.: 10/825,014

(22) Filed: Apr. 15, 2004

(65) Prior Publication Data

US 2005/0264055 A1 Dec. 1, 2005

(51) Int. Cl.
*A47C 31/00* (2006.01)

(52) U.S. Cl. ..... 297/219.12; 297/397; 5/636; 5/655; 5/640

(58) Field of Classification Search ..... 297/391, 297/219.12, 220; 5/655, 652, 636, 640
See application file for complete search history.

(56) References Cited

U.S. PATENT DOCUMENTS 4,383,713 A * 5/1983 Roston ..... 297/228.12
4,434,513 A 3/1984 Welch
4,617,691 A 10/1986 Monti et al.
4,726,085 A 2/1988 Antonio
4,779,930 A 10/1988 Rosen
D328,683 S 8/1992 Kalozdi
5,339,472 A 8/1994 Yin
5,471,690 A * 12/1995 McNeil ..... 5/644
5,486,037 A 1/1996 Harper
5,519,906 A 5/1996 Fanto-Chan
5,580,133 A 12/1996 Knox et al.
5,581,833 A 12/1996 Zenoff
5,586,351 A 12/1996 Ive
5,588,445 A 12/1996 Obaidi
5,669,665 A 9/1997 Nowak
5,675,853 A 10/1997 Linge
5,735,576 A 4/1998 Pepys et al.
5,829,829 A 11/1998 Celestina-Krevh
5,842,739 A 12/1998 Noble
5,918,933 A 7/1999 Hutchinson et al.
5,988,752 A 11/1999 Richards
6,052,848 A 4/2000 Kelly
6,088,855 A 7/2000 Connolly
6,139,100 A 10/2000 Baskin-Lockman et al.
6,266,832 B1 * 7/2001 Ezell ..... 5/655 X
D450,516 S 11/2001 Darling et al.
D450,517 S 11/2001 Darling et al.
6,386,639 B1 5/2002 McMichael
6,779,211 B1 * 8/2004 Williams ..... 5/655
2005/0076443 A1 * 4/2005 Kruger, Jr. ..... 5/636

* cited by examiner

*Primary Examiner*—Anthony D. Barfield
(74) *Attorney, Agent, or Firm*—Taft Stettinius & Hollister LLP

(57) ABSTRACT

A children's pillow adapted for use with a children's car seat comprising: (a) a central area adapted to receive at least a rearward portion of a child's head; (b) a first lateral wing extending from the central area; (c) a second lateral wing extending from the central area; (d) a neck support region; and (e) a retainer adapted to mount the children's pillow to the children's car seat, where the neck support region extends between the first lateral wing and the second lateral wing.

4 Claims, 6 Drawing Sheets

CHILDREN'S CAR SEAT PILLOW

BACKGROUND

1. Field of the Invention

The present invention is directed to a children's pillow, and more specifically to a children's car seat pillow providing support to the neck and head of a child.

2. Background of the Invention

Pillows for children are known in the art. More specifically, pads and contoured cushion inserts are known that may be wedged between a child and a car seat to limit movement of the child with respect to the car seat. In particular, some of these contoured cushion inserts are adapted to fit over the head of the child and rest upon the shoulders of the child to prohibit lateral movement of the child's head with respect to the car seat. However, adequate concurrent support for the neck and padding for the rearward portion of the head is generally lacking.

Thus, it is an object of the present invention to provide a pillow that concurrently provides neck support and cranial padding to a child. It is a further object of the present invention to provide such neck support and cranial padding in the form of a children's car seat pillow, where the pillow may be shaped to provide lateral padding to protect the sides of the child's face. Likewise, it is a still further object of the present invention to provide a children's car seat pillow including neck support and cranial padding that may be reconfigured to adapt to the changing anatomy of the child.

SUMMARY OF THE INVENTION

The present invention is directed to a children's pillow, and more specifically to a car seat children's pillow adapted to provide support to the neck and head of a child. The pillow may include a first piece of a material having an oblong circular shape that is mounted to a second piece of the material having a corresponding oblong circular shape. A packing material is positioned within a cavity formed between the first piece of the material and the second piece of the material to provide a three dimensional body to the pillow. The material utilized for the exterior of the pillow may be adapted for particular applications, but includes, without limitation, fabrics, rubber films, and plastic films.

Further, the pillow may include a central area adapted to accommodate at least a rearward portion of the child's head. The central area may comprise a hole through the first piece of the material and corresponding hole through the second piece of the material. The periphery of the first piece and second piece may be coupled together to close the cavity of the pillow. Alternatively, the central area may simply comprise an indentation formed within the pillow by drawing the first piece closer to the second piece, such as by stitching.

A pillow in accordance with the present invention may be mounted to other pillows made in accordance with the present invention to provide a stacked pillow, where such a stacked pillow may comprise a compilation of pillows mounted approximate a central area.

DETAILED DESCRIPTION

The exemplary embodiments of the present invention are described and illustrated below to encompass children's pillows. Of course, it will be apparent to those of ordinary skill in the art that the preferred embodiments discussed below are exemplary in nature and may be reconfigured without departing from the scope of the present invention. However, for clarity and precision, the exemplary embodiments as discussed below include optional features that one of ordinary skill may recognize as not being a requisite to fall within the scope of the present invention.

Figure 1:
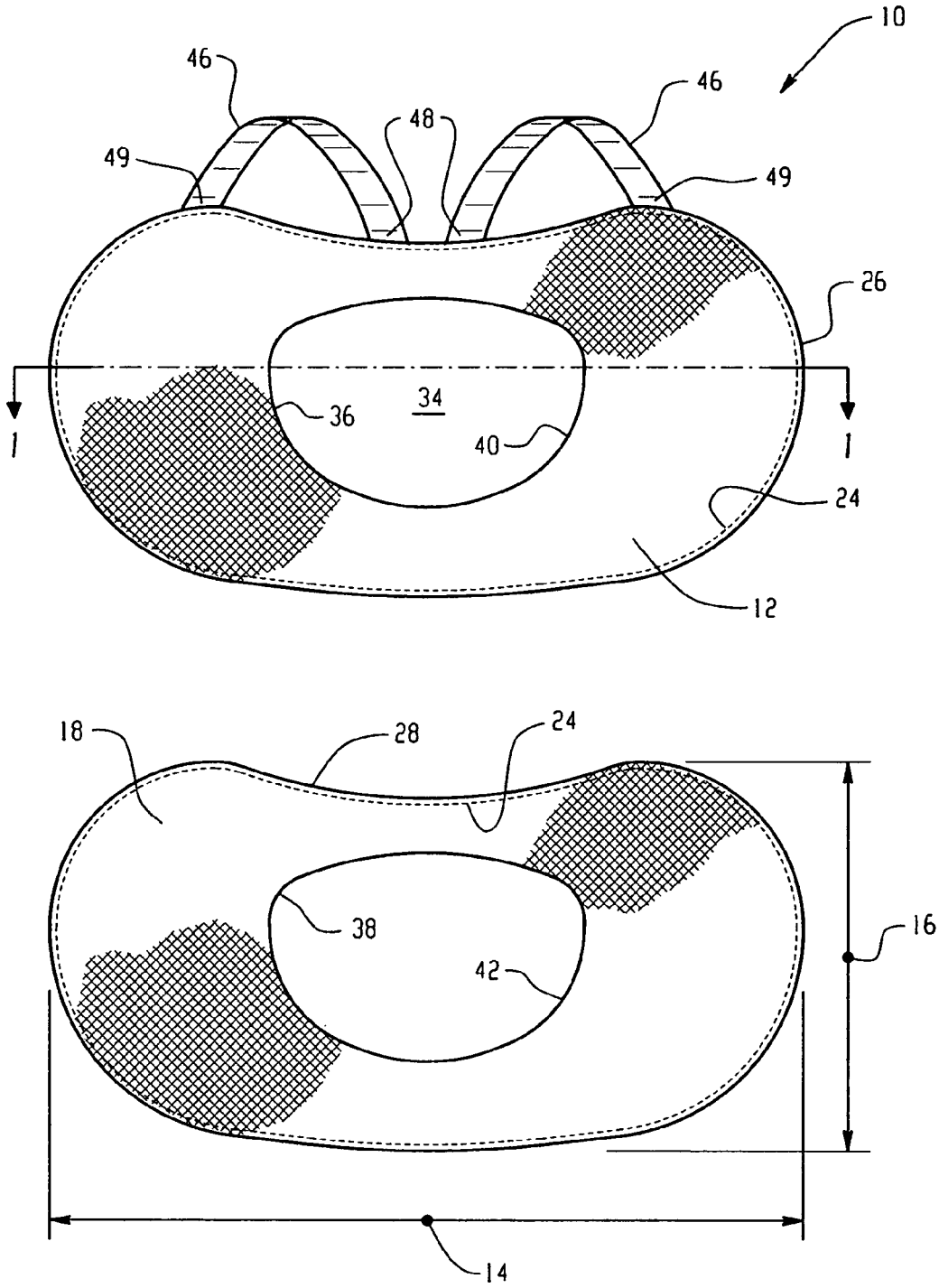
FIG. 1 is overhead view of the component pieces of a first exemplary embodiment of the present invention.
Figure 2:
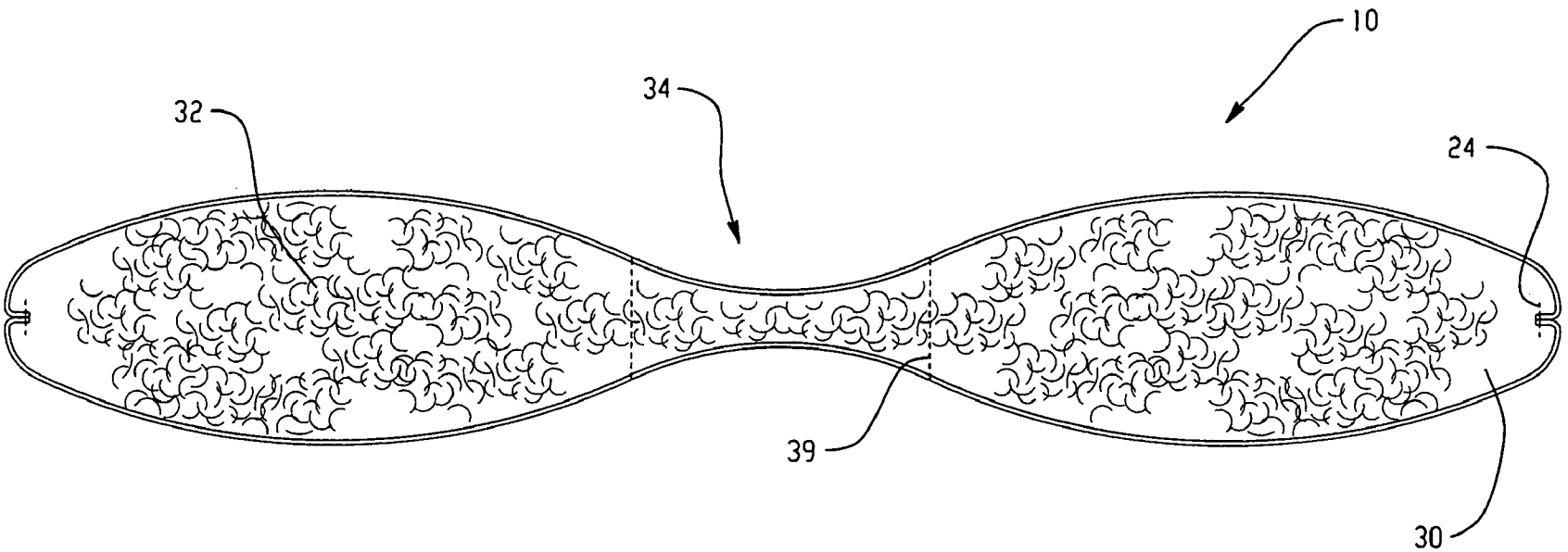
FIG. 2 is a cross-sectional view taken along lines 1-1 of the first exemplary embodiment of the present invention.

Referencing FIGS. 1 and 2, a first exemplary embodiment of the present invention is described below as a children's car seat pillow 10. The pillow 10 includes a first piece of a material 12 in an oblong circular shape having a lengthwise dimension 14 greater than a widthwise dimension 16. The first piece 12 is adapted to be mounted to a second piece of the material 18 that also has a lengthwise dimension 14 greater than a widthwise dimension 16. Exemplary materials 12, 18 for use in the present invention include, without limitation, fabrics, rubber films, and plastic films. Optionally, such materials 12, 18 may include animated characters images, designs, or pictures adapted to be visually appealing to a child.

A peripheral stitch 24 may be utilized to mount a peripheral edge 26 of the first material 12 to a peripheral edge 28 of the second material 18. Likewise, other mounting techniques such as, without limitation, adhesive and heat welding may be utilized to mount the peripheral edges 26, 28 of the materials 12, 18 together. A cavity 30 formed between the first material 12 and the second material 18 may be at least be partially occupied with a stuffing material 32, such as, without limitation, cotton, polyester, or foam. The amount of stuffing material 32 and the positioning of stuffing material 32 allow for various three-dimensional configurations of the pillow 10 that may be appreciated by one of ordinary skill.

The pillow 10 may also include a central area 34 adapted to receive the rearward portion of a child's head. The central area 34 may be delineated at least in part by corresponding holes 36, 38 within the pieces of the material 12, 18. If the central area 34 is delineated at least in party by the corresponding holes 36, 38, an inner circumferential stitch 39 may be utilized to couple internal peripheries 40, 42 of the material 12, 18 that at least partially define the holes 36, 38. The internal peripheries 40, 42 may be coupled before or after the addition of the stuffing material 32 within the cavity 30.

The pillow 10 may also include one or more fasteners 46 adapted to mount the pillow 10 to a car seat (not shown). The fasteners 46 may be comprised of one or more straps, where one end 48 of the strap is rigidly mounted to the pillow 10, and a second opposite end 49 of the strap is removeably mounted to the pillow 10 using Velcro or other device, technique, or process that allows for selective engagement and disengagement. In a preferred embodiment, the fasteners 46 are adapted to ride along the harness straps associated with a child car seat. Those of ordinary skill are familiar with the plethora of other fasteners, connectors, couplings, or otherwise that may be included or used in lieu of those discussed above in each of the exemplary embodiments of the present invention, each of which falls within the scope of the present invention.

Figure 3:
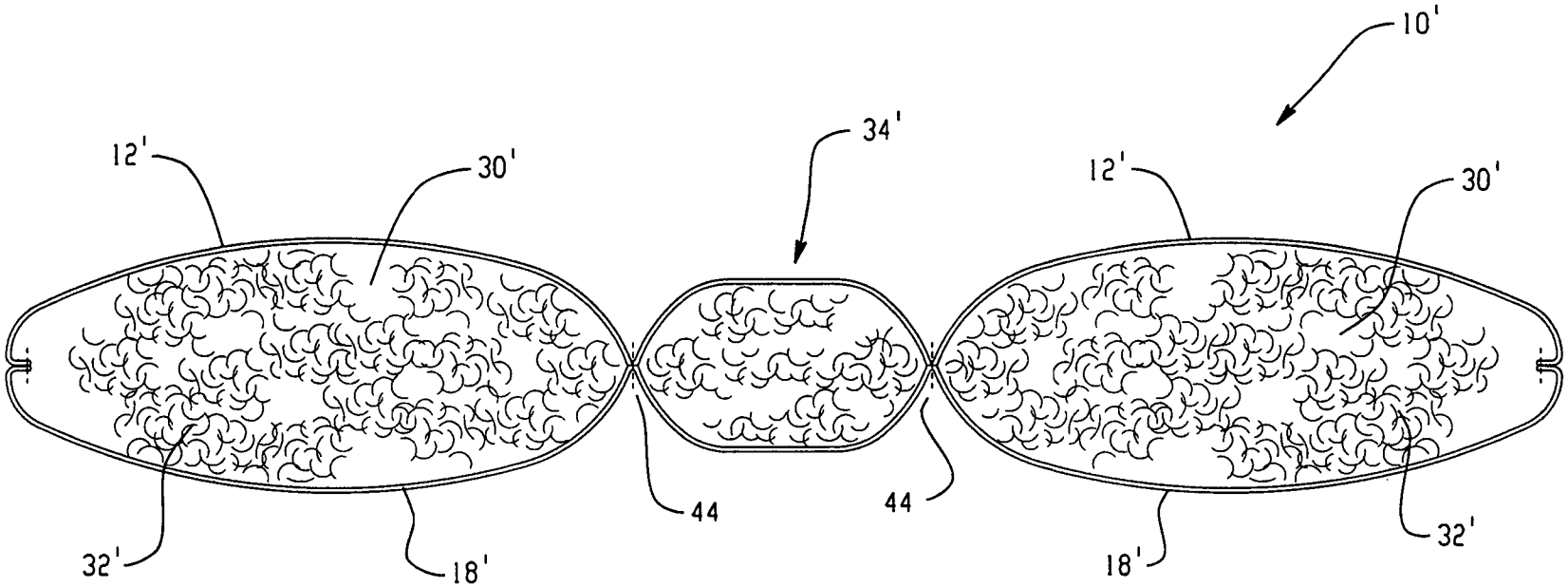
FIG. 3 is a cross-sectional view of a second exemplary embodiment of the present invention.

Referencing FIG. 3, a second exemplary embodiment of a children's car seat pillow 10' may include an interior stitch 44 to delineate the central area 34' where no corresponding holes are present within the first or second piece of material 12', 18'. The stuffing material 32' in the central area 34' and the cavity 30' is at least partially inhibited from migrating between the two by the inner stitch 44, thereby ensuring that the central area 34' and cavity 30' do not meld together. Exemplary inner stitches 44 may include circular stitches, arcuate stitches, or other patterned stitches. As discussed above, stitches may be replaced or supplemented with other mounting mechanisms such as adhesives and other mounting techniques such as heat welding.

Figure 4:
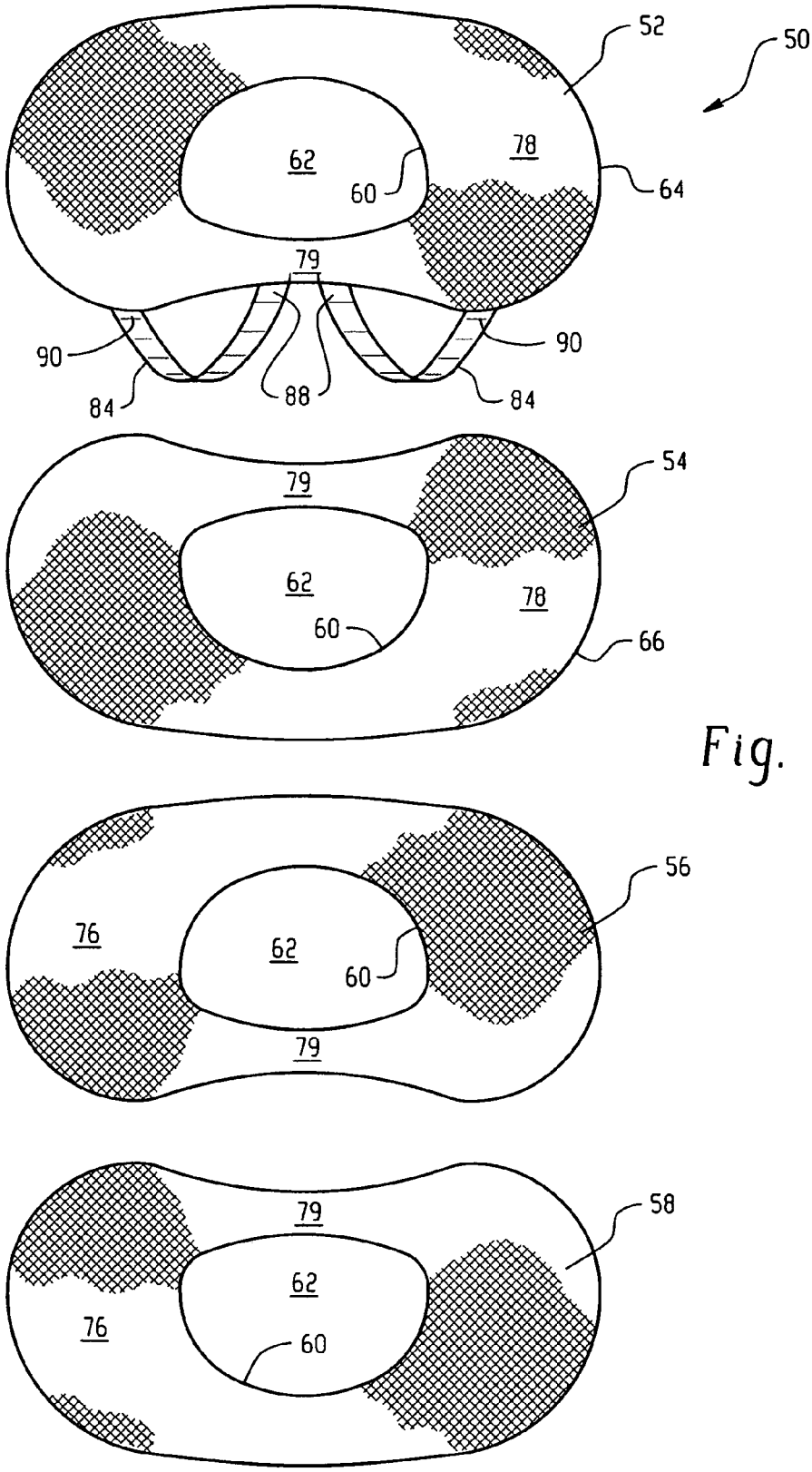
FIG. 4 is an overhead view of the component pieces of a second exemplary embodiment of the present invention.
Figure 5:
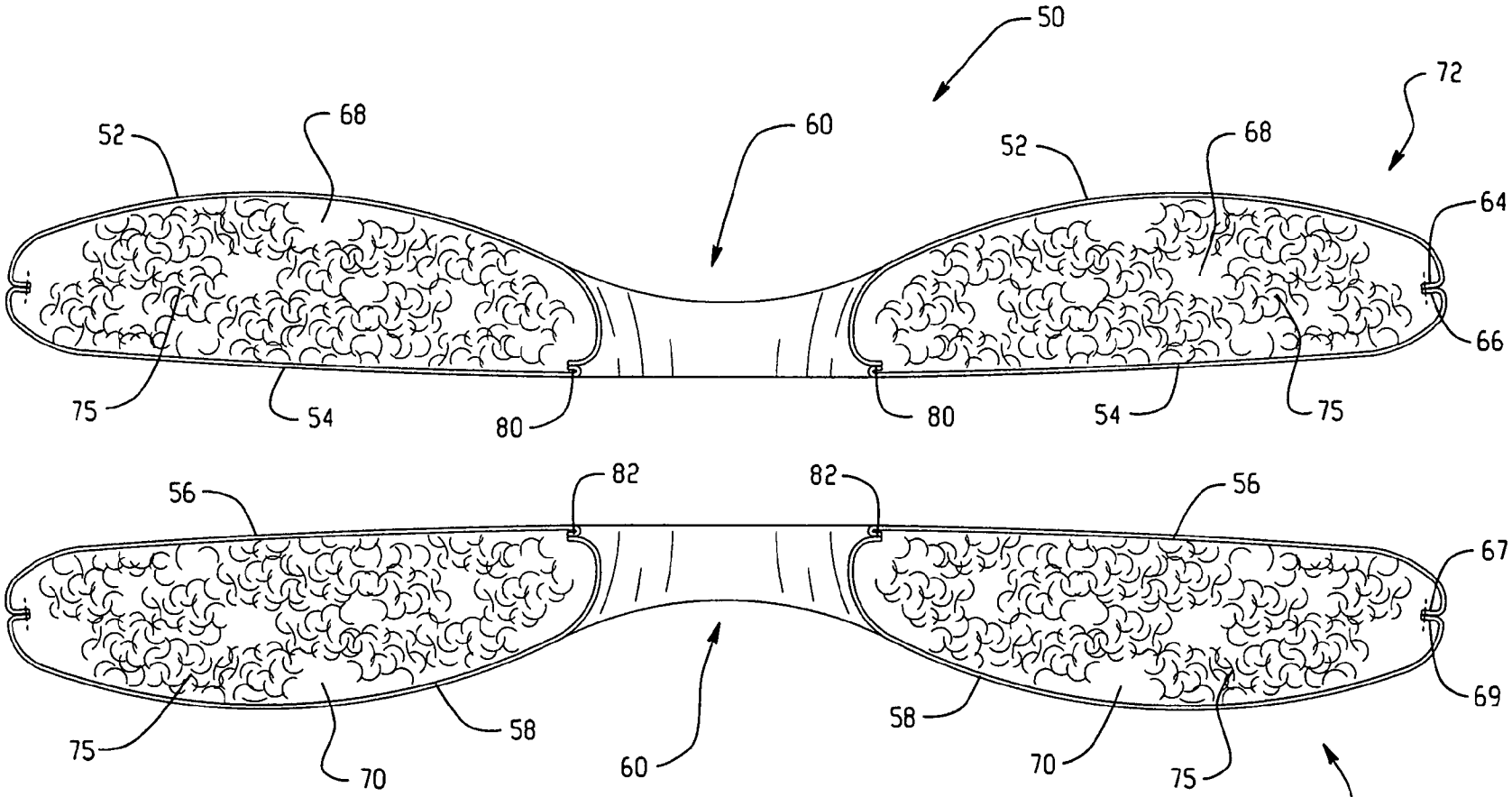
FIG. 5 is a cross-sectional view taken along lines 3-3 of the second exemplary embodiment of the present invention.

Referring to FIG. 4, a third exemplary embodiment of a children's car seat pillow 50 may incorporate two or more pillows 10, 10' of the first and/or second exemplary embodiment or may be created independently from the techniques applicable to the first and second exemplary embodiments. For purposes of explanation only, an exemplary technique will be discussed below to create the second exemplary embodiment 50 that may not necessarily incorporate one or all of the techniques of the first exemplary or second exemplary embodiments.

Four pieces 52, 54, 56, 58 of a material are cut in a generally oblong shape. The first and fourth pieces 52, 58 are generally the same, with the second and third pieces 54, 56 mirroring the dimensions of the first and fourth pieces 52, 58. Each piece 52, 54, 56, 58, for purposes of explanation, includes a hole 60 therethrough. However, it is also within the scope of the invention that less than all of the pieces include a hole therethrough, and further that none of the pieces includes a hole therethrough. The hole 60 generally defines a region 62 adapted to receive the rearward portion of a child's head. After the pieces 52, 54, 56, 58 have been sized and cut, assembly of the pillow 50 may begin.

The first piece 52 is aligned with the second piece 54 in a mirror form such that the holes 60 therethrough are coaxial. Peripheries 64, 66 of the first and second pieces 52, 54 are mounted or stitched together to at least partially define an exterior boundary of a cavity 68 formed therein. Likewise, peripheries 67, 69 of the third piece 56 are aligned and mounted to the fourth piece 58 to at least partially define an exterior boundary of a cavity 70 formed therein. Stuffing 75 is added to each cavity 68, 70 to provide body for the lateral wings 76, 78 and the neck supports 79. The resultant is two articles 72, 74 each having cavities 68, 70 inaccessible via the peripheries 64, 66, 67, 69 of the pieces 52, 54, 56, 58. The two articles 72, 74 are aligned to ensure that the holes 60, neck supports 79, and lateral wings 76, 78 overlap and thereafter the inner circumferential ends 80, 82 of the pieces 52, 54, 56, 58 are mounted or stitched together to finalize the bellowed pillow 50.

The pillow 50 may also include one or more fasteners 84 adapted to mount the pillow 10 to a car seat (not shown). The fasteners 84 may be comprised of one or more straps, where one end 88 of the strap is rigidly mounted to the pillow 50, and a second opposite end of the strap 90 is removeably mounted to the pillow 50 using Velcro or other device, technique, or process that allows for selective engagement and disengagement. In a preferred embodiment, the fasteners 84 are adapted to ride along the harness straps associated with a child car seat. As discussed above, those of ordinary skill are familiar with the plethora of other fasteners, connectors, couplings, or otherwise that may be included or used in lieu of those discussed above in each of the exemplary embodiments of the present invention, each of which falls within the scope of the present invention.

Figure 6:
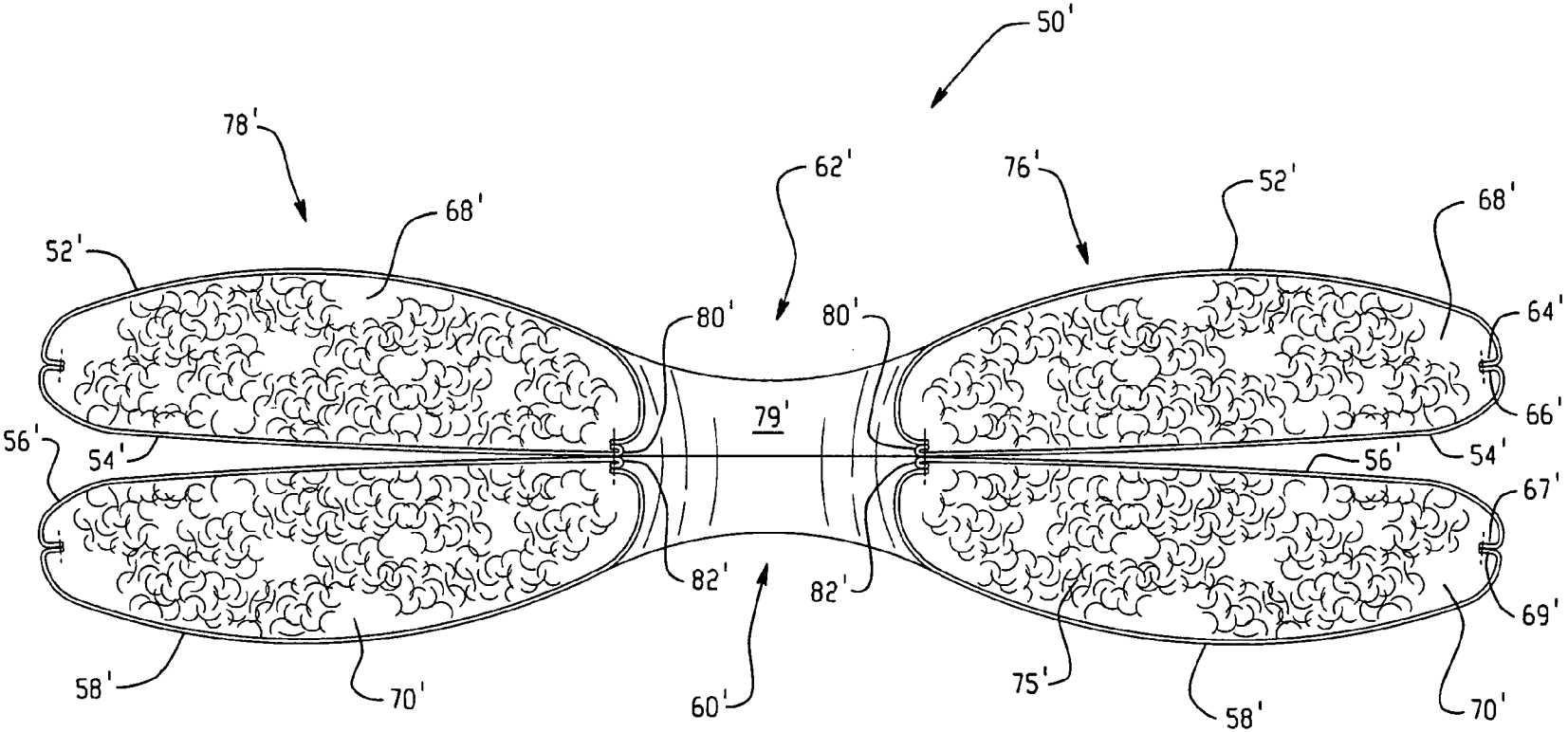
FIG. 6 is a cross-sectional view of a third exemplary embodiment of the present invention.

Referring to FIG. 6, a fourth exemplary embodiment of a children's car seat pillow 50' comprises four pieces 52', 54', 56', 58' of a material cut in a generally oblong shape. The first and fourth pieces 52', 58' are generally the same, with the second and third pieces 54', 56' mirroring the dimensions of the first and fourth pieces 52', 58'. Each piece 52', 54', 56', 58', for purposes of explanation, includes a hole 60' therethrough. However, it is also within the scope of the invention that less than all of the pieces 52', 54', 56', 58' include a hole 60' therethrough, and further that none of the pieces 52', 54', 56', 58' include a hole therethrough. Any such hole 60' generally defines a region 62' adapted to receive the rearward portion of a child's head. After the pieces 52', 54', 56', 58' have been sized and cut, assembly of the pillow 50' may begin.

The first piece 52' is aligned with the second piece 54' in a mirror form such that the holes 60' therethrough are coaxial. Peripheries 64', 66' of the first and second pieces 52', 54' are mounted together to at least partially define an exterior boundary of a cavity 68' formed therein. Likewise, peripheries 67', 69' of the third piece 56' are aligned and mounted to the fourth piece 58' to at least partially define an exterior boundary of a cavity 70' formed therein. Stuffing 75' is added to each cavity 68', 70' to provide body for the lateral wings 76', 78' and the neck supports 79'. The resultant is two articles 72', 74' each having cavities 68', 70' accessible via the inner circumferential free ends 80', 82' of the pieces 52', 54', 56', 58'. The two articles 72', 74' are aligned to ensure that the holes 60', neck supports 79', and lateral wings 76', 78' overlap and thereafter the inner circumferential ends 80', 82' of the pieces 52', 54', 56', 58' are mounted or stitched together to finalize the bellowed pillow 50'.

It is also within the scope and spirit of the present invention to omit the hole 60, 60' in the material approximate the region 62, 62' and simply stitch a pattern to define a central area adapted to receive the rearward portion of a child's head. Such a pattern may include a circular stitch, an arcuate stitch, or another stitch to delineate the central area from the remainder of the pillow 50, 50' and provide sufficient boundaries for the stuffing material 75, 75'. In such an alternate exemplary embodiment, the amount of stuffing material 75, 75' may be varied to achieve the desired effect to delineate the head receiving region 62, 62' from the lateral wing 76, 78, 76', 78' and neck support regions 79, 79', as those of ordinary skill will readily understand.

It is further within the scope of the present invention to provide one or more inflatable cushions between the material layers 52, 54, 56, 58, 52', 54', 56', 58'. Such an exemplary embodiment provides the availability to customize the size and shape of the pillow 50, 50'.

It is likewise within the scope of the present invention to include more than two pillows 10, 10', 50, 50' coupled together to provide a stacked pillow that may be reconfigurable utilizing Velcro or other temporary mounting fastener. Further, is within the scope of the present invention to include a bellowed pillow having more than two stacked layers. From the above description, those of ordinary skill will readily understand and make use of the present invention to provide the above discussed variations without necessitating undue experimentation.

Following from the above description and invention summaries, it should be apparent to those of ordinary skill in the art that, while the methods and apparatuses herein described constitute exemplary embodiments of the present invention, the invention contained herein is not limited to these precise embodiments and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A children's pillow adapted for use with a children's car seat comprising:

a central area adapted to receive at least a rearward portion of a child's head;

a first lateral wing extending from the central area;

a second lateral wing extending from the central area;

a neck support region;

a retainer adapted to mount the children's pillow to the children's car seat; and a third lateral wing extending from the central area; and a fourth lateral wing extending from the central area;

wherein the neck support region extends between the first lateral wing and the second lateral wing;

wherein the central area includes a stitched pattern;

wherein the central area includes a hole therein bounded in part by the stitched pattern;

wherein the movement of the first lateral wing, the second lateral wing, the third lateral wing, and the fourth lateral wing are independent of one another.

2. The children's pillow of claim 1, wherein:

the first lateral wing is adapted to be adjacent to the third lateral wing;

the second lateral wing is adapted to be adjacent to the fourth lateral wing; and the third lateral wing and the fourth lateral wing at least partially define the central area.

3. The children's pillow of claim 1, wherein the retainer includes at least one reconfigurable loop.

4. The children's pillow of claim 1, wherein:

the retainer includes a strap; and the strap is at least one of permanently attached to the children's pillow and selectively coupled to the children's pillow.

* * * * *